United States Patent [19]

Schmidt et al.

[11] Patent Number: 4,529,046

[45] Date of Patent: Jul. 16, 1985

[54] DEVICE FOR PRODUCING BOREHOLES IN COAL OR THE LIKE

[76] Inventors: Bruno H. Schmidt, Niederkasseler Kirchweg 34, 400 Düsseldorf 11; Helmut Becker, Franz-Fischer-Weg 61, 43 Essen, both of Fed. Rep. of Germany

[21] Appl. No.: 594,295

[22] Filed: Mar. 28, 1984

Related U.S. Application Data

[63] Continuation-in-part of Ser. No. 327,891, Nov. 24, 1981, Pat. No. 4,440,242.

[30] Foreign Application Priority Data

Nov. 25, 1980 [DE] Fed. Rep. of Germany ..... 3044263

[51] Int. Cl.[3] ..... E21B 7/18

[52] U.S. Cl. ..... 175/107; 175/67

[58] Field of Search ..... 175/107, 67, 103, 220, 175/422; 415/80, 82, 502, 503; 239/240, 246

[56] References Cited

U.S. PATENT DOCUMENTS

| | | | |
|---|---|---|---|
| 1,860,214 | 5/1932 | Yeaman | 175/107 |
| 2,967,577 | 1/1961 | Tiraspolsky | 175/107 |
| 3,576,222 | 4/1971 | Acheson | 175/422 X |
| 3,640,352 | 2/1972 | Stuart | 175/107 |
| 4,333,539 | 6/1982 | Lyons et al. | 175/107 X |

*Primary Examiner*—Stephen J. Novosad
*Assistant Examiner*—Thuy M. Bui

[57] ABSTRACT

Apparatus for drilling geological formations includes a hydraulic motor through which a high pressure fluid is delivered to plural nozzles which define material cutting jets. A portion of the fluid supplied to the motor is diverted and employed to generate a torque which causes the rotation of the rotor of the motor, which is mechanically connected to the drill head which includes the cutting jet defining nozzles, about the motor stator. The apparatus is connected to a source of pressurized fluid and thrust nozzles may be employed to position of the motor and associated drill during the boring operation.

6 Claims, 4 Drawing Figures

DEVICE FOR PRODUCING BOREHOLES IN COAL OR THE LIKE

CROSS-REFERENCE TO RELATED APPLICATION;

This application is a continuation-in-part of application Ser. No. 327,891 filed Nov. 24, 1981, Now U.S. Pat. No. 4,440,242.

BACKGROUND OF THE INVENTION (1) Field of the Invention

The present invention relates to the drilling of geological formations and particularly to the perforation of the face of a coal seam. More specifically, this invention is directed to apparatus for forming boreholes in coal or the like and especially to hydraulic drilling apparatus. Accordingly, the general objects of the present invention are to provide novel and improved methods and apparatus of such character.

(2) Description of the Prior Art

While not limited thereto in its utility, the present invention is particularly well suited for use in the mining of coal and especially in the formation of boreholes in the exposed face of a coal seam. The conventional method of forming such boreholes, which may be employed for the placement of explosives, has utilized mechanical drilling employing a spiral boring bar. Such boring bars may have a rod length of 1.5 m and be rotated either manually or by a carriage-mounted boring machine. If a boring machine is employed, the machine will be advanced towards the coal face either by hand or by a pneumatic drive.

Hand boring is a very laborious task, particularly in hard coal or other coals which may be bored only with difficulty. The use of carriage-mounted boring machines is often precluded by a lack of space and/or time.

In the interest of overcoming the problems briefly discussed above, it has been proposed to employ high pressure jets of water to form holes in a geological formation, particularly a coal face. Such proposed hydraulic drilling apparatus would employ a stationary nozzle to which the high pressure water was delivered via a conduit. The use of such water jets emanating from stationary nozzles has not proven to be a successful approach. It has additionally been proposed to modify the previously employed carriage-mounted boring machines so that the drill bit was replaced by a combined flushing and boring bit comprising nozzels to which high pressure water was delivered. Such a modified boring machine would, however, require a special rotatable boring bar which could tolerate water pressures of up to 350 bars and which would thus be expensive to produce. In addition, specially designed high pressure flushing heads would be required in order to insure that the water would penetrate into the bar which was rotated during the boring operation. The replacement of a mechanical boring bit by a nozzle head, which was itself mechanically rotated, will not result in any advantage or operational progress when compared to simple mechanical drilling.

SUMMARY OF THE INVENTION

The present invention overcomes the above-discussed and other deficiencies and disadvantages of the prior art and, in so doing, provides apparatus for forming boreholes in geological formations. Apparatus in accordance with the invention is characterized by simplicity, reliability and moderate cost. These improvements are embodied in a novel hydraulic drill which receives all the necessary energy for operation from a conventional, and customarily available, source of high pressure fluid.

Apparatus in accordance with the present invention comprises a boring head which includes a hydraulic motor driven by high-pressure water. The hydraulic motor converts a portion of the energy of the water supplied to the apparatus to rotary motion. This rotary motion is delivered to a hydraulic drill comprising a plurality of nozzles which form high pressure jets which are caused to impinge upon the surface to be drilled. In order to produce the desired rotary motion, the hydraulic motor includes discharge ports through which a portion of the high pressure water supplied to the apparatus is discharged at an angle which respect to the axis of the motor. This angular discharge exerts a torque on the rotatable portion of the motor and thereby causes rotation thereof. Apparatus in accordance with the invention may also comprise means for guiding the boring head in the borehole and thrust nozzles which serve to equalize the axial forces on the hydraulic motor rotor.

Thus, to summarize, apparatus in accordance with the present invention may be employed to produce boreholes in geological formations and comprises a boring head including a hydraulic motor intended to be connected to a pressurized source of water. This hydraulic motor has a rotatable member, i.e., a rotor, which is coupled to a drill head from which the pressurized water emerges, preferably as plural jets, to perform the boring operation. The hydraulic motor also includes discharge ports from which a portion of the water supplied thereto is discharged in such a manner as to generate a torque which causes the rotation of the hydraulic motor rotor relative to the stator, i.e., the stationary portion of the motor. In the present embodiment the rotor of the hydraulic motor rotates about the stator and both the rotor and stator may be at least in part housed within a protective sleeve.

BRIEF DESCRIPTION OF THE DRAWING

The present invention may be better understood and its numerous object and advantages will become apparent to those skilled in the art by reference to the accompanying drawing wherein like reference numerals refer to like elements in the various FIGURES and in which.

DESCRIPTION OF THE DISCLOSED EMBODIMENTS

Figure 1:
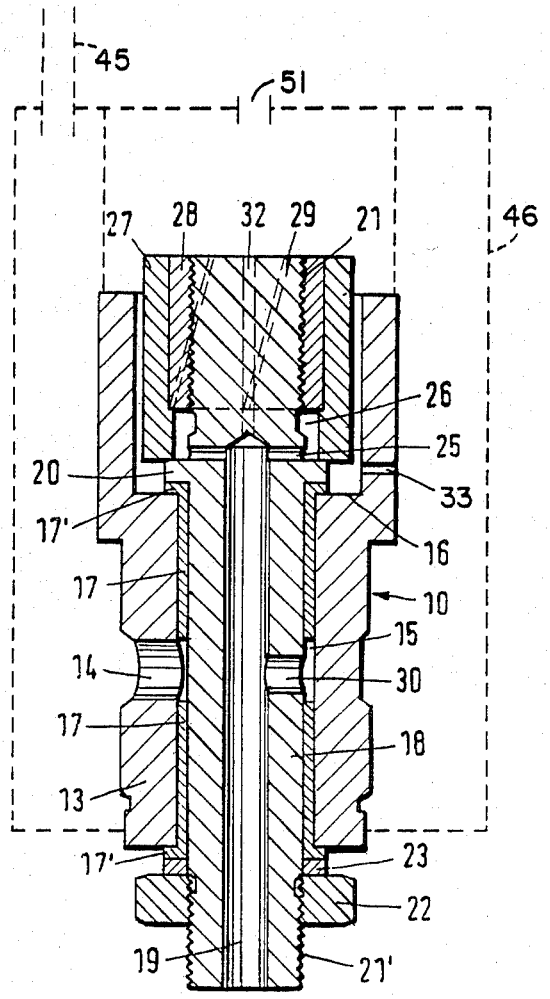
FIG. 1 is a cross-sectional side elevation view of drilling apparatus in accordance with a first embodiment of the invention, the housing for the motor portion of the apparatus being shown schematically in FIG. 1.
Figure 1:
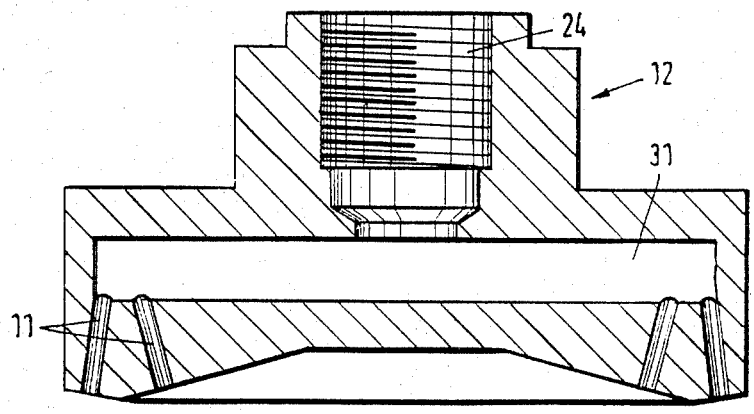

With reference to the drawing, apparatus in accordance with the present invention comprises two basic subsystems. The first of these subsystems is a hydraulic motor which is indicated generally at 10. Hydraulic motor 10 is coupled to a drilling head which is indicated generally at 12. The drilling head 12 is shown on an enlarged scale when compared to the showing of motor 10 in FIG. 1. The drilling head 12 includes a plurality of nozzles 11 which define the jets of high pressure fluid which impinge on and thus cut the material which comprises the formation being drilled.

The hydraulic motor 10 comprises a casing 13 which should not be confused with an outer housing, indicated in phantom, through which the hydraulic fluid is delivered to the apparatus. In the embodiment of FIG. 1, casing 13 functions as the stator of motor 10 and will be provided with one or more radially oriented supply ports 14 through which the pressurized water or other fluid is delivered into the cylindrical central bore 15 defined by casing 13. Continuing to discuss the FIG. 1 embodiment, the central bore 15, and thus also the casing 13, is provided with an upper portion of increased diameter which is, in part, defined by a shoulder 16. A pair of bushings 17 are inserted into the bore 15 of casing 13 from the opposite ends thereof. The bushings 17 are each provided with an outwardly extending flange 17'. These flanges respectively contact the shoulder 16 and the end of casing 13 disposed opposite to shoulder 16 and thus determine the limits of insertion of the bushings. The length of the bushings is selected such that they terminate short of the supply ports 14 whereby the inflow of the pressurized hydraulic fluid is not impeded by the bushings.

The bushings 17 guide an inwardly disposed member 18 which, in the embodiment of FIG. 1, functions as the rotor of motor 10. Rotor 18 is provided with an axially extending blind bore 19 which is open at the front or lower end of motor 10. Rotor 18 is also provided with an outwardly extending flange 20 which rests on the flange 17' of the upper one of the two bushings 17. The rotor 18 is provided with a portion which extends above flange 20 and which, in part, has an external thread 21. The opposite end of rotor 18 is also provided with an external thread 21'. Rotor 18 is retained within casing 13 by means of a nut 22, which engages the thread at the lower end thereof, and a washer 23 which contacts the nut 22 and the flange 17' on the lower of the bushings 17. A portion of the threaded lower end of rotor 18 projects beyond nut 22 and engages a complimentary internal thread of an axial bore 24 in the drill head 12. The nut 22 also serves as a lock nut for drill head 12.

The axial blind hole 19 in rotor 18 is provided, adjacent the inwardly disposed end thereof, with a plurality of radially outwardly extending passages 25. Passages 25 terminate in an annular chamber 26 which is defined by the flange 20 on rotor 18, the body of the rotor above the flange and a pair of sleeves 27 and 28. Sleeve 28 contacts the upper surface of flange 20 of rotor 18 and is captured by the internally threaded inner sleeve 28 which engages the thread 21 at the upper end of rotor 18. A plurality of discharge passages or ports 29 extend from annular chamber 26 to the upper end of rotor 18. The discharge passages 29 are preferably defined by helical or spiral grooves formed in the outer surface of sleeve 28. The passages 29 discharge pressurized fluid in an axially inclined direction into the housing and these discharges generate a reaction force having a radial component. The axial bore 19 of rotor 18 is also intercepted by one or more radial passages 30 at a point intermediate its length. The passage or passages 30 establish communication between the supply ports 14 and the axial bore 19 via the central bore 15 of casing 13. The rotor 18 will be supported within the casing 13 so as to be free to rotate, i.e., there will be both radial and axial clearance between the stationary and relatively movable components of motor 10.

The drill head 12, which defines the nozzles 11, will include a radially extending bore or chamber 31 which establishes fluid communication between the threaded bore 24 and nozzles 11. Accordingly, fluid supplied to motor 10 via supply ports 14 will flow down the axial bore 19 of rotor 18 to drill head 12 and thence to nozzles 11 and will also flow upwardly in bore 19 for discharge via passages 29 to generate a rotation causing force.

The motor 10 as depicted in FIG. 1 will, of course, be mounted with a holder or housing through which the high pressure water feed takes place. As noted, the high pressure water will enter the central bore 15 through the supply ports 14 and, via the axial passages 30, will flow into the bore 19 of rotor 18. The high pressure water flowing into bore 19 will be directed both to the nozzles 11, from which it emerges as high-pressure water jets, and through passages 25 to the annular chamber 26 from which it is discharged via the angularly inclined passage 29. Because of the inclination of the passages 29, the high pressure water flowing therethrough will exert a torque on rotor 18 and the rotor will thus be set into rotational motion. As result of the rotation of rotor 18, the drill head 12, and thus the nozzles 11, will also rotate.

In addition to the inclined discharge passages 29, rotor 18 may also be provided with a small diameter central axial discharge passage 32 which communicates with bore 19. If passage 32 is present the discharge therefrom will provide a reaction force which compensates for any axial force imbalance between the upward force produced by the discharge from nozzles 11 and any downward component of force resulting from the discharge from the inclined passages 29. Thus, the inclusion and sizing of passage 32 will insure that rotor 18 "floats" in casing 13. This force compensation may also be achieved through the sizing and adjustment of the discharge angle of the passages 29.

The hydraulic fluid delivered to motor 10 also serves to lubricate the rotor 18. Accordingly, the rotor 18 need not be mounted in bearings. Similarly, seals are not required since the fluid delivered to the motor is allowed to flow out freely. In order to insure that no ramming pressure arises during starting, and thus in order to prevent any axial rearward thrust, an opening 33 may be provided in casing 13 in the region of shoulder 16.

The rotational speed of rotor 18 will be a function of the number and inclination of the passages 29 and the pressure of the fluid delivered to the motor. Rotational speeds exceeding 5,000 rpm, in fact speeds on the order of magnitude of 10,000 to 20,000 rpm, can readily be obtained. The source pressure of the water delivered to motor 10 will typically be in the range of 300 to 500 bars, but could be in excess of 1,000 bars.

In the FIG. 1 embodiment, the drill head 12 comprises a first pair of oppositely disposed nozzles 11, which have their axes inclined slightly outwardly with respect to the axis of the motor, and two further nozzles which have their axes inclined slightly inwardly toward the axis of the motor, the angles of inclination being stated in respect to the direction of fluid flow through the nozzles. The nozzles 11 are disposed symmetrically about the axis of the motor. The diameter of the hole which is bored is determined by the positioning and inclination angle of the outer nozzles in drill head 12. The inner nozzles, i.e., the nozzles which discharge at an inwardly inclined angle, serve to shatter the bore core. The outer configuration of the drill head 12 may be cylindrical. However, to allow for the removal of the material which is separated from the formation being drilled, it is desirable for the drill head 12 to deviate from the cylindrical shape and, for example, to have a rectangular cross-section. It is also to be noted that the nozzles 11 need not be disposed symmetrically about the axis of the device. Thus, it is possible to employ only a single pair of oppositely inclined nozzles at one side of the drill head.

Should the rotational speed of motor 10 prove to be too great, which may be the case when the passages 29 are employed to achieve the axial force balance, it is possible to employ one or more discharge passages 29 which have an inclination which is opposite to the other passages to thereby limit the rotational speed. As noted above, the sizing and number of the passages 29 may be selected primarily to achieve the desired rotational speed while axial reaction compensation is achieved through the use of the bore 32.

It will also be apparent to those skilled in the art that the discharge passages 29 may be arranged in a radial plane such that the discharge therefrom would be in the lateral direction with no axial force component being produced. The discharge passages 29 may also tangentially discharge into the housing.

As will be explained in the description of FIGS. 3 and 4, it is also possible to restrain the inner member 18 from rotation whereupon the outer member 13 will become the rotor which, of course, will be mechanically connected to the drill head 12.

Figure 2:
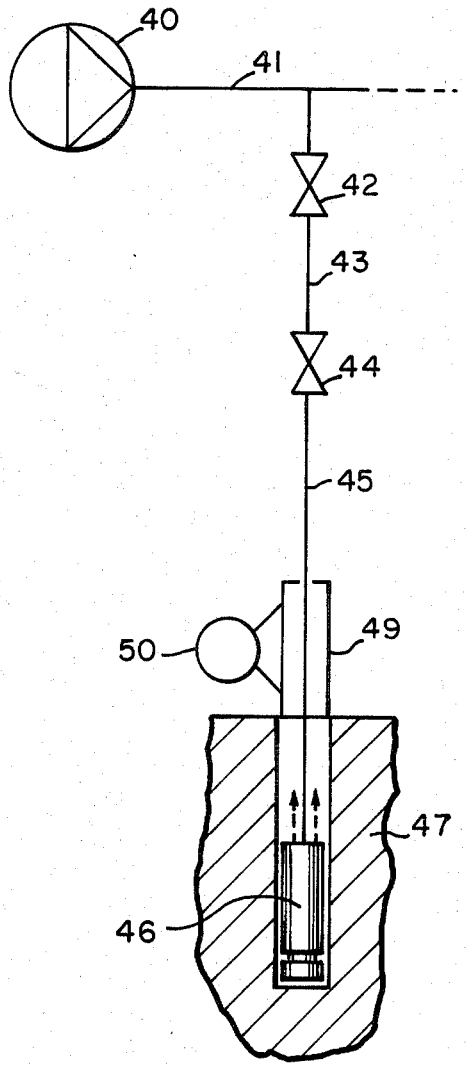
FIG. 2 is a schematic diagram which illustrates the use of the borehole producing device of the present invention.

Referring now to FIG. 2, a source of highly pressurized fluid, typically water, is indicated at 40. Source 40 is coupled, via a hose or conduit 41, to a valve 42. The downstream side of valve 42 is, in turn, coupled to a fast-acting control valve 44 by means of a high-pressure hose 43. Valve 44 can be operated either by hand or foot. The downstream side of control valve 44 is connected, by means of a further high-pressure hose 45, to the housing of the apparatus of FIG. 1, the housing being indicated in FIG. 2 at 46. The complete boring head, is employed to form boreholes, in material 47 which may, for example, be a coal face. The boring head is supported in a tubular guide device 49. By providing one or more nozzle-shaped high pressure discharge ports, indicated schematically at 51, in FIG. 1 in the housing 46 of the boring head, these further discharge ports 51 being oriented in the opposite direction to the desired drilling direction as indicated by arrows on FIG. 2, a propelling thrust may be generated so that the boring head together with the high-pressure hose 45 connected thereto is able to position itself and generate a forward feed thrust toward the formation 47. Since the rotor 18 of the boring head is reaction-compensated, the boring head may slide into a previously drilled borehole without any additional aid to maintain the apparatus in the correct position for the boring operation.

In order to commence the boring of a new borehole, the guide 49 may be used. The guide 49 holds the boring head for movement therein and determines the drilling direction. The guide 49 may, for example, be mounted on a support 50 which is adjustable in height and possibly also in angular orientation.

The water containing the cuttings, which leaves the borehole, is collected in the tubular guide 49 and, by means not shown in the drawing, led away from the apparatus. The guide 49 thus preferably remains associated with the boring head during the entire drilling operation. As indicated in FIG. 2, the hose 45 passes through the guide 49 to the boring head.

Figure 3:
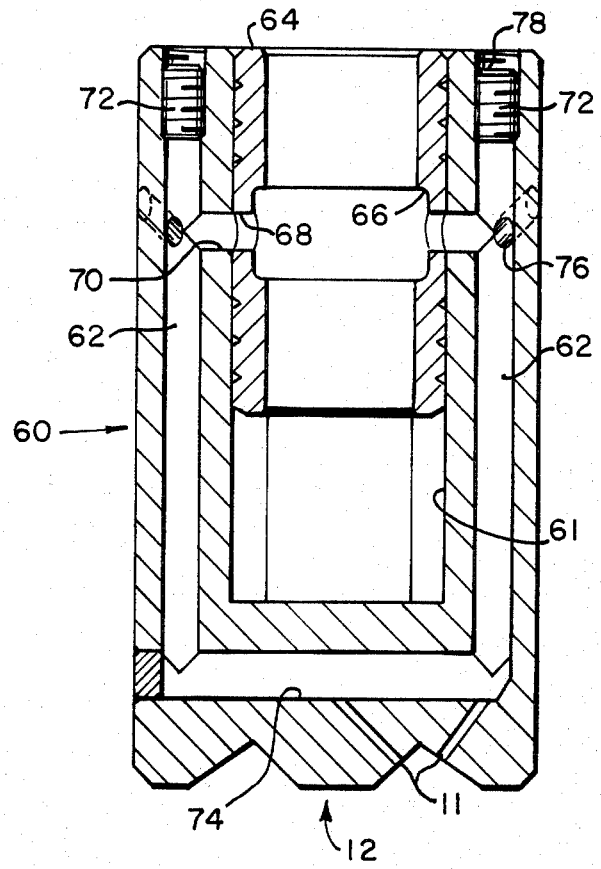
FIG. 3 is a cross-sectional side elevation view of the rotor of a hydraulic motor in accordance with a second embodiment of the present invention.
Figure 4:
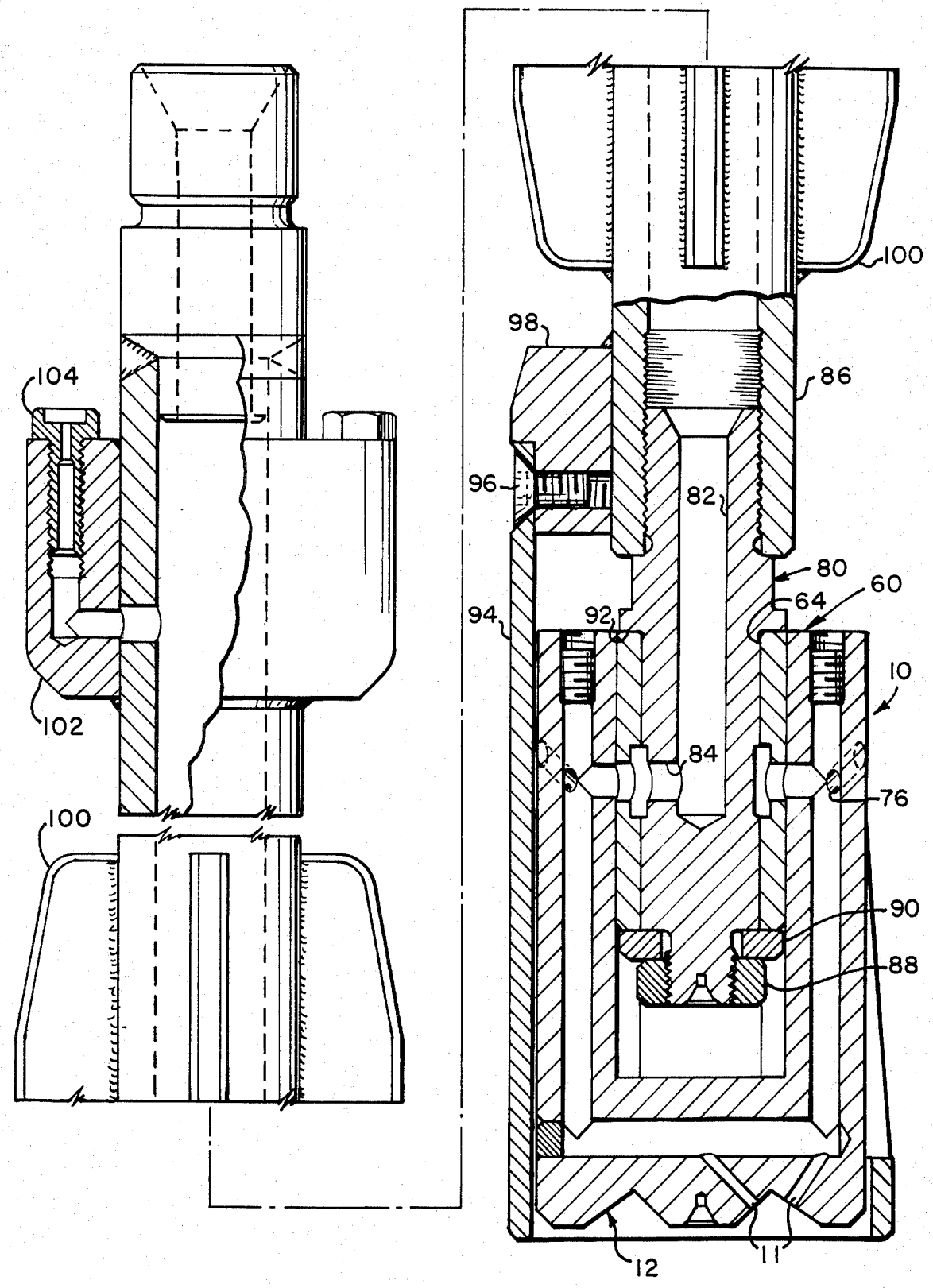
FIG. 4 is an exploded view, partly in section, of a hydraulic motor which employs the rotor of FIG. 3.

The embodiment of FIGS. 3 and 4 differs from that of FIG. 1 principally in the configuration of the hydraulic motor 10. Thus, in the embodiment of FIGS. 3 and 4 the member 60 which function as the rotor is positioned outwardly with respect to and rotates about the member 80 which functions as the stator. As described above, the hydraulic motor of FIG. 1 has the opposite arrangement, i.e., the rotor 18 is mounted within the stator 13.

With reference to FIG. 3, which depicts the rotor by itself, it is to be noted that the drill or cutting head 12, which has the cutting jet defining nozzles 11 formed therein, is shown as being integral with the rotor. It will be understood that cutting head 12 could be a separate element which is affixed, in any suitable manner including use of a threaded coupling as in the FIG. 1 embodiment, to the rotor. Rotor 60 comprises an inner member which defines an opening 61. Opening 61 terminates at a point which will leave sufficient material to permit formation of head 12. Rotor 60 is provided with at least a pair of bores 62 which are generally parallel to the axis of rotor 60. A bushing 64 will be positioned in rotor 60 and will rotate therewith. Bushing 64 will be of annular shape and will be provided, intermediate its ends, with a cut-out 66. Cut-out 66 cooperates with the stator, in the manner depicted in FIG. 4, to define an annular chamber. Bushing 64 is provided, in the region of the cut-out 66, with apertures 68 which communicate with the bores 62 via apertures 70 which are formed in the wall of the member which defines opening 61, the apertures 70 being transverse to bores 62 and being in registration with the apertures 68 in bushing 64. The upper ends of the bores 62 are sealed by means of plugs 72. In the base portion of rotor 60, i.e., between the bottom of opening 61 and the cutting head 12, a cross bore 74 will be formed. Cross bore 74 communicates with the aforementioned bores 62. The nozzles 11 communicate with the cross bore 74.

Rotor 60 will also be provided with a plurality of additional passages 76 which communicate with the bores 62. The axes of passages 76 are angled such that fluid discharged therethrough will, in the manner described above with respect to passages 29 of the FIG. 1 embodiment, cause the rotor 10 to rotate relative to the stator of the hydraulic motor, the stator being received in the opening 61 in rotor 60 as may be seen from FIG. 4. The passages or bores 76 discharge within the plane of the rotor surfaces, i.e., perpendicular the plane of the drawing. A groove or grooves may be provided in the outer surface of bushing 64 for receiving an adhesive used for securing the bushing 64 to rotor 60.

It is to be noted that rotor 6o and cutting head 12 (without bushing 64), when viewed from the forward end, have a preferably parallelepipedic configuration and in lateral view a generally U-shaped configuration.

Referring now to FIG. 4, the rotor 60 of FIG. 3 is mounted on, and rotates about, a stator 80. Stator 80 is provided with a blind hole 82 through which the pressurized operating fluid for motor 10 is delivered. Stator 80 is, adjacent the lower end thereof, provided with a radial flow passage 84 which communicates with the cut-out 66 in bushing 64. Thus, fluid delivered via a tubular hanger 86, which is threadably coupled to stator 80, will be routed to the bores 62 in rotor 60 and will be discharged therefrom via the rotational drive inducing nozzles 76 and the cutting jet producing nozzles 11.

The desired axial positioning of rotor 60 on stator 80 is accomplished through the use of nut 88 and support ring 90, nut 88 engaging a threaded projection on the end of stator 80. The bushing 64 is loosely captured between the support ring 90 and a shoulder 92 formed on the exterior of stator 80. The radial component of force resulting from the discharge of pressurized fluid through the nozzles 76 will, accordingly, cause the rotor assembly, including bushing 64, to rotate about the stator 80 thus imparting rotation to cutting head 12.

The hydraulic motor/cutting head assembly is provided with a protective sleeve 94. Sleeve 94 is mounted, by means of one or more bolts 96, to a sleeve support 98 which is welded to the hanger 86.

A plurality of guide ribs 100 are provided above motor 10 and extending outwardly from hanger 86. The guide ribs 100 may, for example, be welded to hanger 86.

In the disclosed embodiment, the hanger 86 is also provided, in a region displaced at the opposite sides of the guide ribs 100 from the motor 10, with means which defines at least a pair of reaction jets which drive the entire motor/cutting-head assembly toward the formation being drilled. In the disclosed embodiment the reaction jet defining means comprises a housing 102 which is provided with at least a pair of oppositely disposed L-shaped flow passages. These flow passages communicate with the interior of casing 86 whereby portion of the fluid being delivered to motor 10 may be diverted to produce the propulsion force for the apparatus. The L-shaped bores in casing 102 are provided with nozzle-defining inserts 104 which are sized to produce the desired thrust.

As explained above, the cutting nozzles are set into rotation by means of a diverted portion of the high pressure hydraulic fluid delivered to the hydraulic motor. Using a hydraulic motor, of the type shown in FIGS. 1 and 4, very high rotational speeds can be obtained, these speeds exceeding 5,000 rpm and generally being in the range of 10,000 to 20,000 rpm. This high speed rotation of the jets of water which perform the cutting function leads to a substantially improved cutting action and this, in turn, leads to a substantially lower expenditure of energy for a given drilling operation and a substantially increased drilling speed. The rotational speed of the drill head can, as noted above, be controlled by the positioning and configuration of the discharge passages 29 (FIG. 1) or 76 (FIG. 4) and by controlling the supply pressure. A particularly significant aspect of the present invention resides in the fact that the hydraulic motor 10 is of uncomplicated construction and thus of comparatively modest cost. This is particularly important since, under mining conditions, there is the ever present danger of loss of the apparatus. The unique construction of the hydraulic motor of the drilling device of the present invention also eliminates the need for bearings and seals. As also noted above, while the cutting jet forming nozzles can be arranged symmetrically with respect to the axis of the apparatus, an increased point-force can be achieved by a non-symmetrical, and particularly a one-sided, arrangement.

The high-pressure water or other hydraulic fluid is, in accordance with the present invention, used simultaneously for cutting, imparting rotation to the drill and for forward feed of the drill. This insures that the head is guided in the borehole. Since the boring head is connected to a high-pressure hose, the problems associated with the manufacture and use of a special rotatable boring bar are eliminated.

In order to start a new borehole, a guide device such as a pipe may be employed. This guide device may, for example, be affixed to an adjustable support. The water which emerges from the borehole, and which contains the drill cuttings, is collected in this guide pipe and lead off. The guide pipe may remain in position during the complete boring operation in which case the high pressure feed hose will be led through the guide pipe to the boring head.

Employing the apparatus of the present invention it is possible to produce impregnation holes of the requisite diameter with a depth of up to about 50 mm in a very simple and expeditious manner.

In addition, boreholes of great depth, such as those having length exceeding several hundred meters, can be produced employing the present invention. Such long boreholes may, for example, be desired when the depth of a coal face is to be determined. When employing the present invention to drill holes of great depth, problems which have plagued the prior art, particularly those problems associated with off-centering of the bore when using a mechanical boring bar, are eliminated.

While preferred embodiments have been shown and described, various modifications and substitutions may be made thereto without departing from the spirit and scope of the invention. Thus, while the present invention has been described primarily in connection with the formation of holes in a coal mining operation, it is equally well-suited for use in the mining of other materials such as limestone, gypsum or the like for the purpose of producing bores in the rock to be mined. Accordingly, it will be understood that the present invention has been described by way of illustration and not limitation.

What is claimed is:

1. Hydraulic drilling apparatus comprising a boring head, said boring head including a hydraulic motor which is driven by pressurized fluid, said motor including a rotor having an axis, said boring head further including a head containing nozzles from which fluid is discharged as plural cutting jets, said rotor being connected to said head and also including at least a first fluid discharge passage, said discharge passage being angularly oriented with respect to said axis whereby the fluid discharged therefrom will exert a torque on said rotor to impart rotational motion thereto, and a stator, said stator being coaxial with said rotor, the pressurized fluid being delivered to said rotor through said stator, said rotor rotating about said stator.

2. The apparatus of claim 1 further comprising means for guiding said boring head and means for connecting said hydraulic motor to a source of pressurized fluid.

3. The apparatus of claim 1 wherein said drilling apparatus further comprises thrust nozzles, a portion of the fluid delivered to said motor being discharged through said thrust nozzles to generate a force which urges said boring head toward the material to be drilled.

4. The apparatus of claim 3 further comprising means for guiding said boring head and means for connecting said hydraulic motor to a source of pressurized fluid.

5. The apparatus of claim 4 wherein a plurality of angularly oriented discharge passages are provided in said rotor.

6. Hydraulic drilling apparatus comprising:

stator means, said stator means having an axis, said stator means defining at least a first fluid flow path;

means coupling said stator means to a source of pressurized fluid; and rotor means positioned outwardly from and coaxially with respect to said stator means, said rotor means having a cutting head at a first end thereof, said cutting head defining a plurality of nozzles which discharge cutting jets from a face thereof and at an angle with respect to said axis whereby fluid cutting of a medium impinged upon by said jets will be induced, said rotor means further defining a plurality of discharge ports displaced from said cutting head, said discharge ports being oriented to provide fluid streams having a component of motion which is angularly related to said axis whereby rotational force relative to said stator means will be provided, said rotor means additionally defining flow passages which establish fluid communication between said stator means defined first flow path and said nozzles and ports.

* * * * *